US008783500B1

(12) United States Patent
McPeek et al.

(10) Patent No.: US 8,783,500 B1
(45) Date of Patent: Jul. 22, 2014

(54) SLIDING LOCK MECHANISM

(75) Inventors: Mark V. McPeek, Cedar Rapids, IA (US); Roger D. Eller, Cedar Rapids, IA (US); Josh M. Roe, Cedar Rapids, IA (US); Stephen R. Blair, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 944 days.

(21) Appl. No.: 12/885,506

(22) Filed: Sep. 18, 2010

(51) Int. Cl.

| | |
|---|---|
| ***B65D 25/06*** | (2006.01) |
| ***B65D 85/38*** | (2006.01) |
| ***B65D 85/86*** | (2006.01) |
| ***B65D 5/50*** | (2006.01) |
| ***B42F 17/14*** | (2006.01) |
| ***G06F 1/18*** | (2006.01) |
| ***H05K 5/00*** | (2006.01) |

(52) U.S. Cl.
USPC ..... 220/545; 220/529; 220/544; 220/559; 220/720; 206/758; 206/759; 312/223.2; 312/273; 403/83; 108/147.19

(58) Field of Classification Search
USPC ..... 220/529, 544, 545, 559, 720; 206/751, 206/754, 755, 758, 759; 361/679.41; 190/36; 312/223.2, 273, 312; 403/83; 108/147.19
See application file for complete search history.

(56) References Cited

U.S. PATENT DOCUMENTS

| | | | | |
|---|---|---|---|---|
| 6,059,498 | A * | 5/2000 | Ostrowski | 410/100 |
| 7,665,709 | B2 * | 2/2010 | Cvek | 248/669 |

* cited by examiner

*Primary Examiner* — Fenn Mathew
*Assistant Examiner* — Jennifer Castriotta
(74) *Attorney, Agent, or Firm* — Donna P. Suchy; Daniel M. Barbieri

(57) ABSTRACT

A sliding lock mechanism that utilizes a binding bar to prevent movement of a sliding member on a slide rail in at least one direction. A spring mechanism exerts a biasing force on the binding bar to maintain the locked position. The binding bar can be moved to an unlocking position by overcoming the bias of the spring. This then allows movement of the sliding member in two directions on the slide rail. An actuating rod moves the binding bar between the first and second positions. The mechanism can be added to a stowing mechanism for a laptop or other device that can secure different devices with varying widths within a compartment due to a drive spring mechanism. The addition of the locking mechanism allows for greater security of the laptop during periods of vibration and prevents backdriving of the spring mechanism.

19 Claims, 11 Drawing Sheets

SLIDING LOCK MECHANISM

CROSS-REFERENCE TO RELATED APPLICATIONS

The present application is being filed concurrently with application Ser. No. 12/885,501 entitled "Device Stowing Mechanism" and by the same inventors as the present application, which application is hereby incorporated by reference in its entirety to the present application.

BACKGROUND

Devices are known for locking objects or systems from movement in one or more directions. Such devices can utilize different mechanisms to direct and impede those movements.

SUMMARY OF THE INVENTION

A sliding lock mechanism selectively prevents movement of a sliding carriage on a slide rail in one direction by use of a binding bar which is pivoted with respect to the slide rail such that the binding bar engages the slide rail. The bias of a spring keeps the binding bar in the locked or first position.

The binding bar can be moved to an unlocked second position which pivots the binding bar toward a perpendicular position with respect to the slide rail, therefore, allowing movement of the sliding carriage in two directions. The second position of the binding bar is achieved by overcoming the bias of the spring. An actuating rod moves the binding bar from the locked position to the unlocked position.

The sliding lock mechanism can be used in conjunction with a stowing mechanism for a laptop or other device and can utilize some of the same parts of the stowing mechanism. A slide rail, sliding carriage and actuator rod used by the sliding lock mechanism can be the same components as used in a stowing mechanism for a laptop or other device. In such an application, the locking mechanism prevents backdriving of the spring driven linkage mechanism of the stowing mechanism.

DETAILED DESCRIPTION

Figure 1:
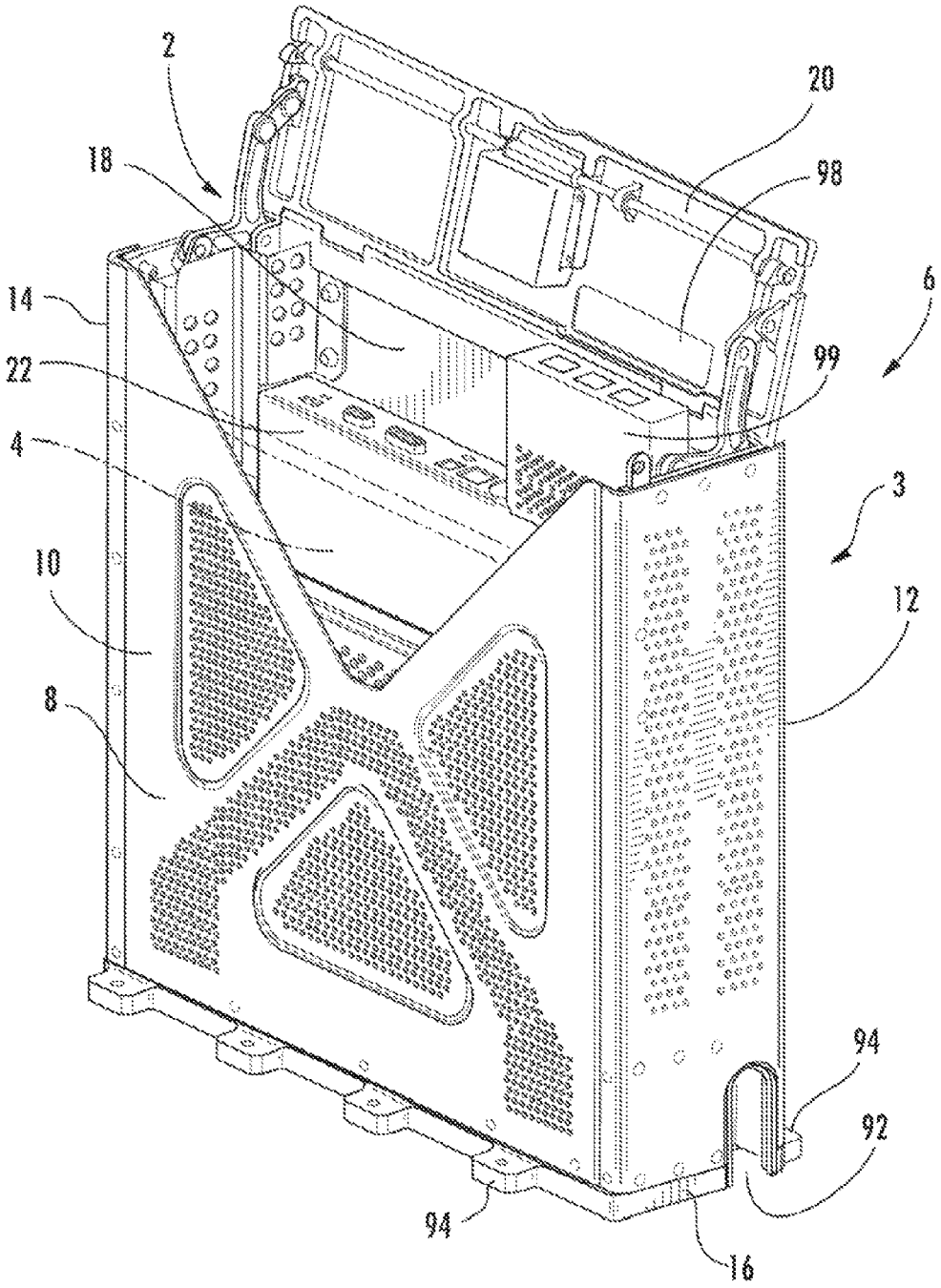
FIG. 1 is a perspective view of the present invention stowing mechanism showing a laptop computer or other device positioned within a compartment of the stowing mechanism.

Now referring to the drawings, FIG. 1 shows a stowing mechanism 2 for a laptop or other device 4 held within a compartment 6 in a vertical configuration. The compartment 6 can be a space defined by a portion of the housing 8, which can be a front wall 10; two side walls 12, 14; a base 16; a rear wall 18; and a cover 20. These components combine to form a box 3, which surrounds the laptop 4 and protects it from external impact or other damage. The housing can be perforated to allow for cooling air flow. In addition to the laptop 4, the box 3 can also house an interface device 22, which can include a power supply having the ability to power a variety of brands and types of laptops or other devices. Thus, the interface device can recharge batteries or provide external power to the device, whether the device is in use or not when stowed in the stowing mechanism. The interface device can also include other connectors for connecting to a laptop video output, for connecting the laptop 4 to a network, for connecting external control devices to the laptop 4 and for making any other desired connections with the laptop or other device 4. These connections can be made between the interface device 22 and the laptop or other device 4 via connector cables having appropriate connector ends. The box 3 can also house a control panel 99 for controlling the laptop 4, which control panel 99 is accessible through a window 98 in cover 20 when the cover 20 is in a closed position.

Figure 2:
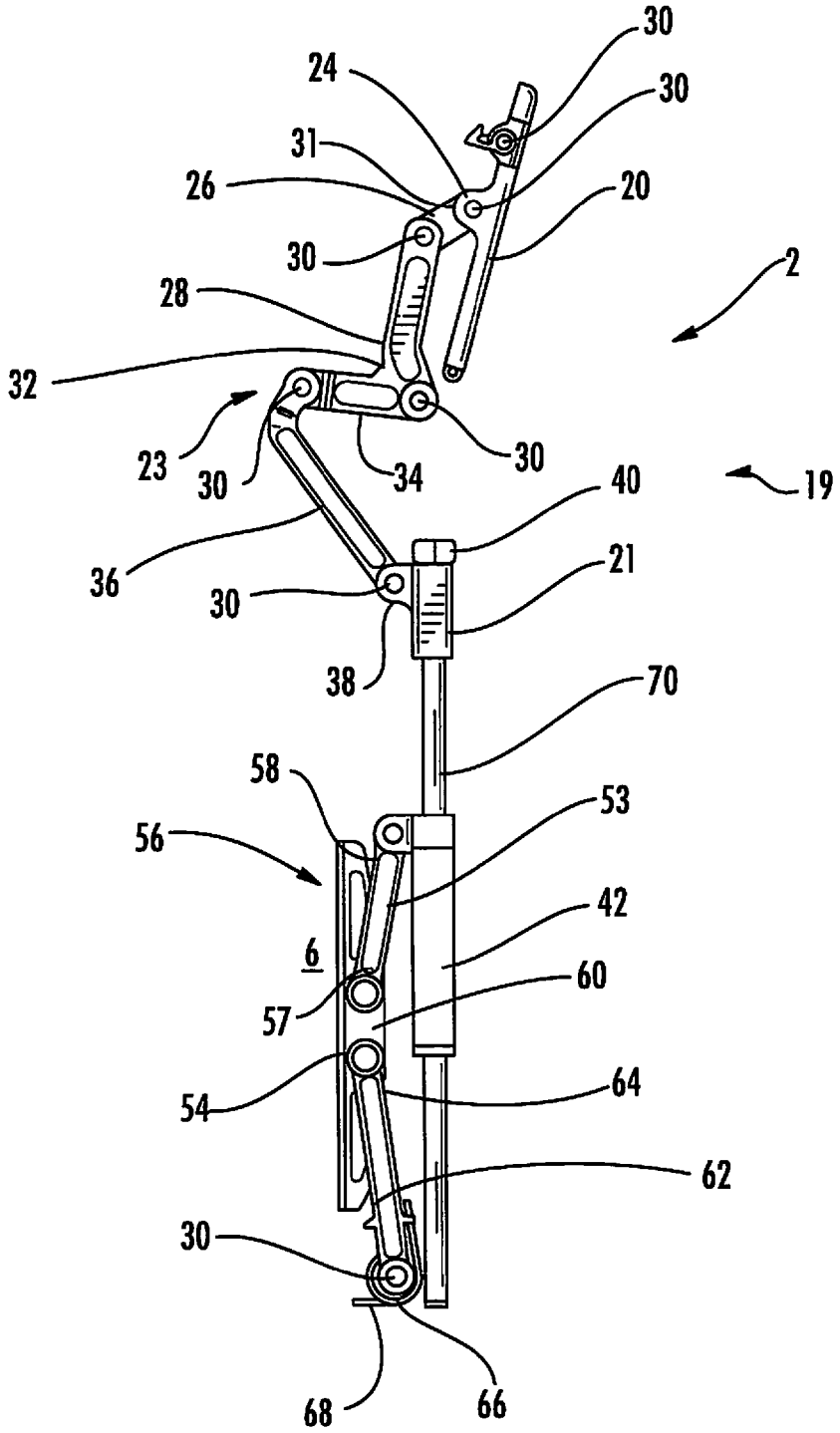
FIG. 2 is a cut away side view of the stowing mechanism in an open position.
Figure 3:
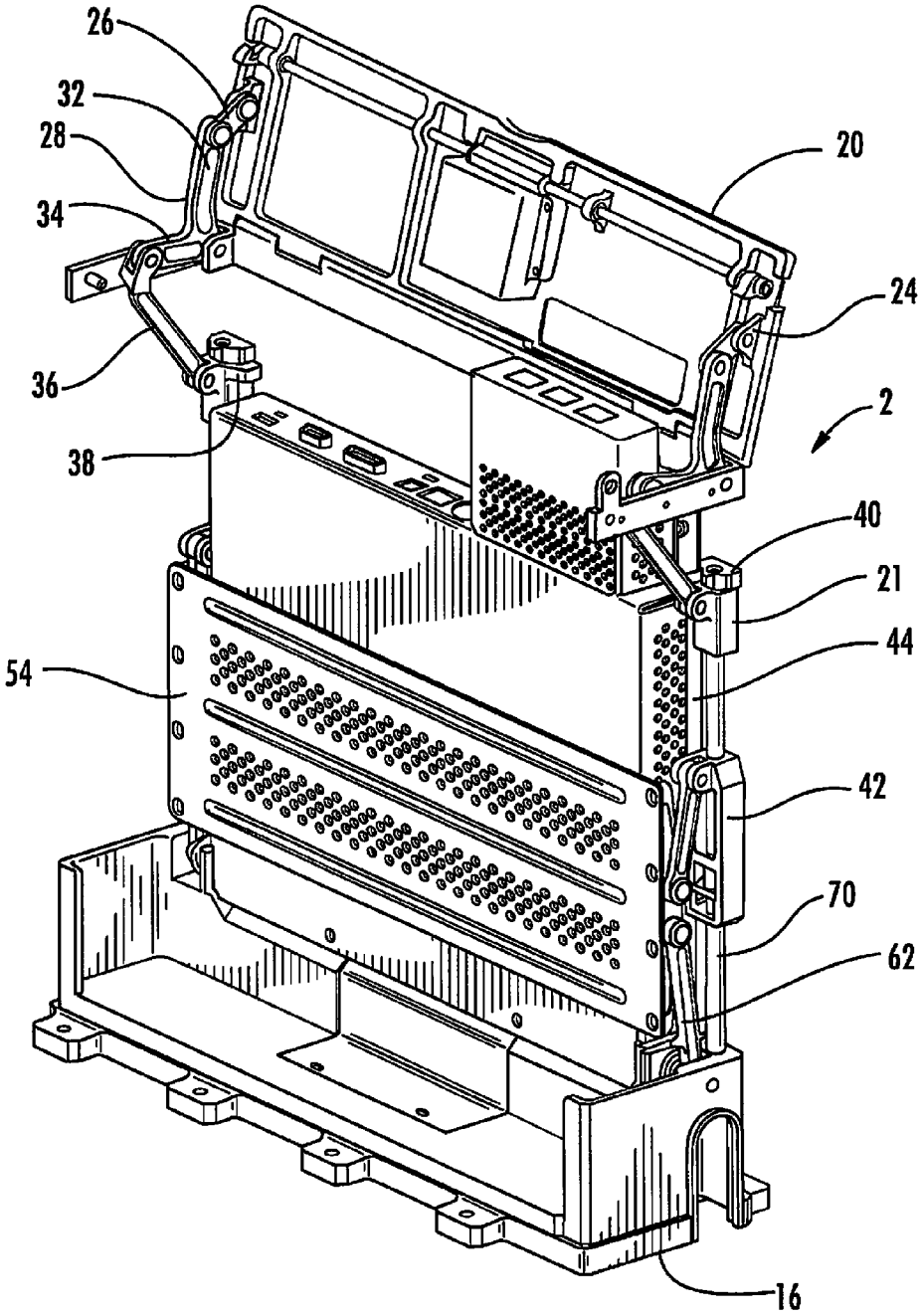
FIG. 3 is a cut away front perspective view of the stowing mechanism in an open position mounted on a base.
Figure 4:
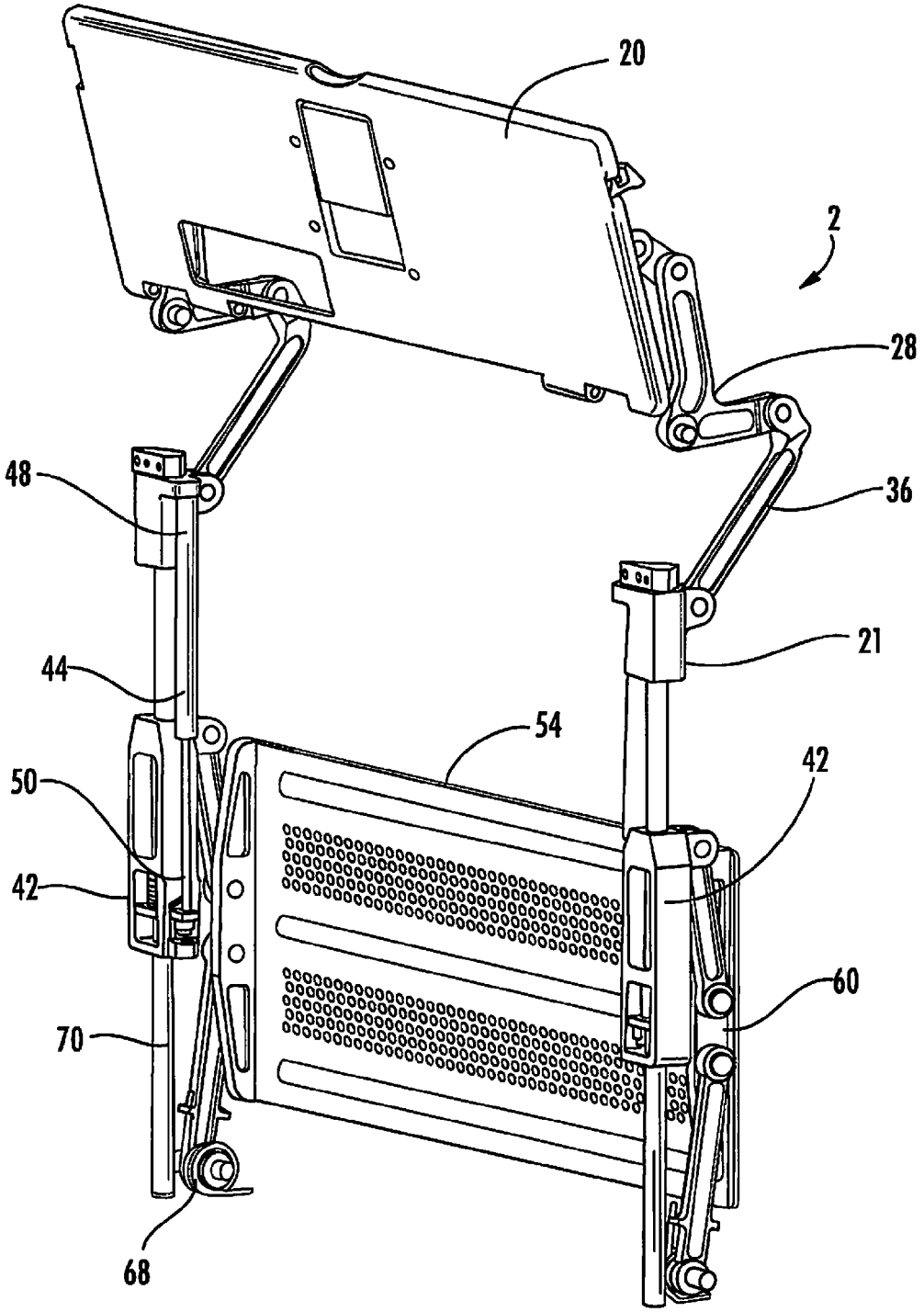
FIG. 4 is a cut away rear perspective view of the stowing mechanism in an open position.

FIGS. 2-4 show an embodiment of the stowing mechanism 2 in a first position corresponding to an open position. In this open position, the laptop or other device 4 can be loaded into the compartment 6. The cover 20 is in a near vertical position and is pivotally attached to one of the parts defining the space of the compartment 6, the rear wall 18 in this embodiment.

Through a system of operating linkages 19, including cover linkages 23, the cover 20 is in communication with a pair of driving carriages 21. One side of the mechanism will now be described, with the opposite side having the same detail. See, for instance, FIG. 4. It will be noted that the stowing mechanism can operate with a pair of opposed mechanisms as shown, with only a single mechanism, or with more than two mechanisms.

The cover 20 can have a depending ear 24 which is connected to an L-shaped pivot arm 28 via a first connecting member 26. The points of connection between the ear 24, first connecting member 26 and pivot arm 28 are all pivotable and each held together with pivot pins 30, which each engage a respectively positioned bore 31 in each of the cover linkages 23. The pivot arm 28 has a first extending link 32 and a second extending link 34 which are generally perpendicular to one another in the preferred embodiment, forming an L-shape. The first extending link 32 is longer than the second extending link 34 to increase leverage as the cover 20 is moved between the closed and open positions. The pivot arm 28 is pivotally attached via pivot pin 30 to one of the stationary structures, such as a side wall 12, 14 and/or the rear wall 18. A second connecting member 36 is pivotally attached at one end to the second extending link 34 via one of the pivot pins 30, and also pivotally attached at an opposite end to a flange 38 of the driving carriage 21. The second connecting member 36 is shaped to provide clearance space for a mounting bracket 40 while the mechanism 2 is in a closed position, and in this embodiment is somewhat L-shaped. See FIGS. 5-7 to see how the L-shaped second connecting member 36 clears the mounting bracket 40 when the stowing mechanism is in the closed position.

The driving carriage 21 is in further connection with a sliding carriage 42 via a drive spring 44 (see FIG. 4). In the preferred embodiment, the drive spring 44 is a gas spring having a first end 48 and second end 50, wherein the first end 48 is attached to an inner flange of the driving carriage 21 and the second end 50 is attached to an inner side of the sliding carriage 42. In this embodiment, first end 48 is the cylinder of the gas spring 44 and the second end 50 is the ram 52 of the gas spring 44, although this can be reversed. In the preferred embodiment, the gas spring 44 is vertically positioned, in alignment with a slide rail 70 on which the driving carriage 21 and sliding carriage 42 move. The use of a gas spring 44 also provides damping to the mechanism which improves performance of the mechanism under vibration.

The sliding carriage 42 is in turn connected to a pressure plate 54 via a first linkage arm 53 of a jack mechanism 56. The first linkage arm 53 has a first end 57 pivotally attached to the sliding carriage 42 and a second end 58 pivotally attached to a flange 60 which extends from and is attached to the pressure plate 54. The flange 60 can be a separate component attached to the pressure plate 54 or can be integral with the pressure plate 54. A second linkage arm 62 has a first end 64 and a second end 66. The first end 64 is also pivotally attached to the flange 60, below the location where the first linkage arm 53 attaches to the flange 60. This configuration allows the pressure plate 54 to pivot in two locations and better secure differently shaped laptops, and especially, laptops that have covers/bases slanted toward a front or rear side. The second linkage arm 62 is pivotally attached via second end 66 to a stationary structure such as the side wall 12, 14. A second spring 68 is positioned between the second linkage arm 62 and the stationary structure to bias the second linkage arm 62, and the pressure plate 54, toward an unsecured position in a direction away from the laptop or other device. Alternatively, the second spring 68 can also be operatively positioned between the second linkage arm 62 and the pressure plate 54, between the first linkage arm 53 and the pressure plate 54 or the sliding carriage 42, between the pressure plate 54 and the stationary structure, or elsewhere. A second spring 68 can also be positioned in multiple positions.

Figure 5:
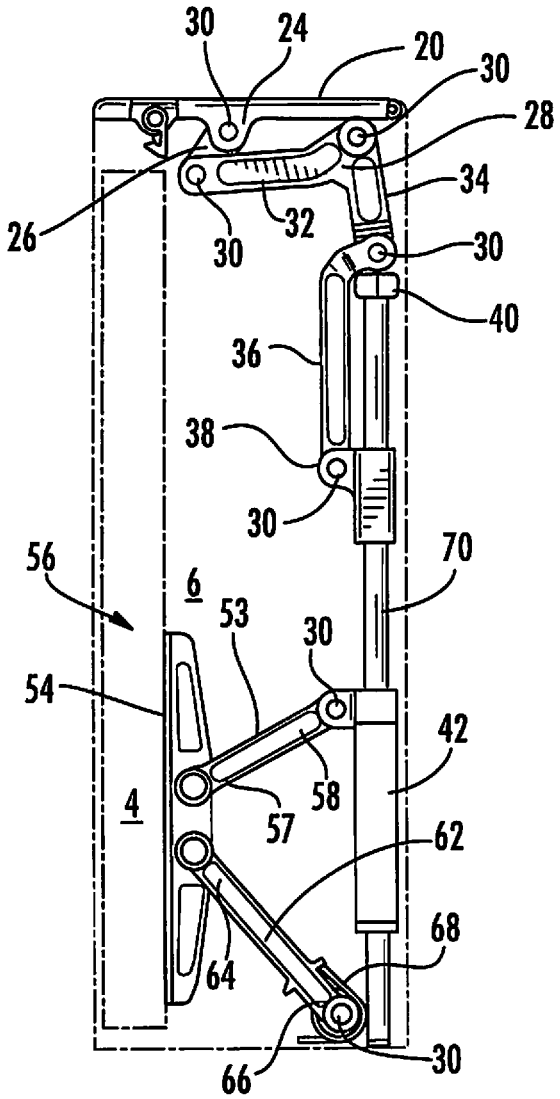
FIG. 5 is a cut away side view of the stowing mechanism in a closed position.
Figure 6:
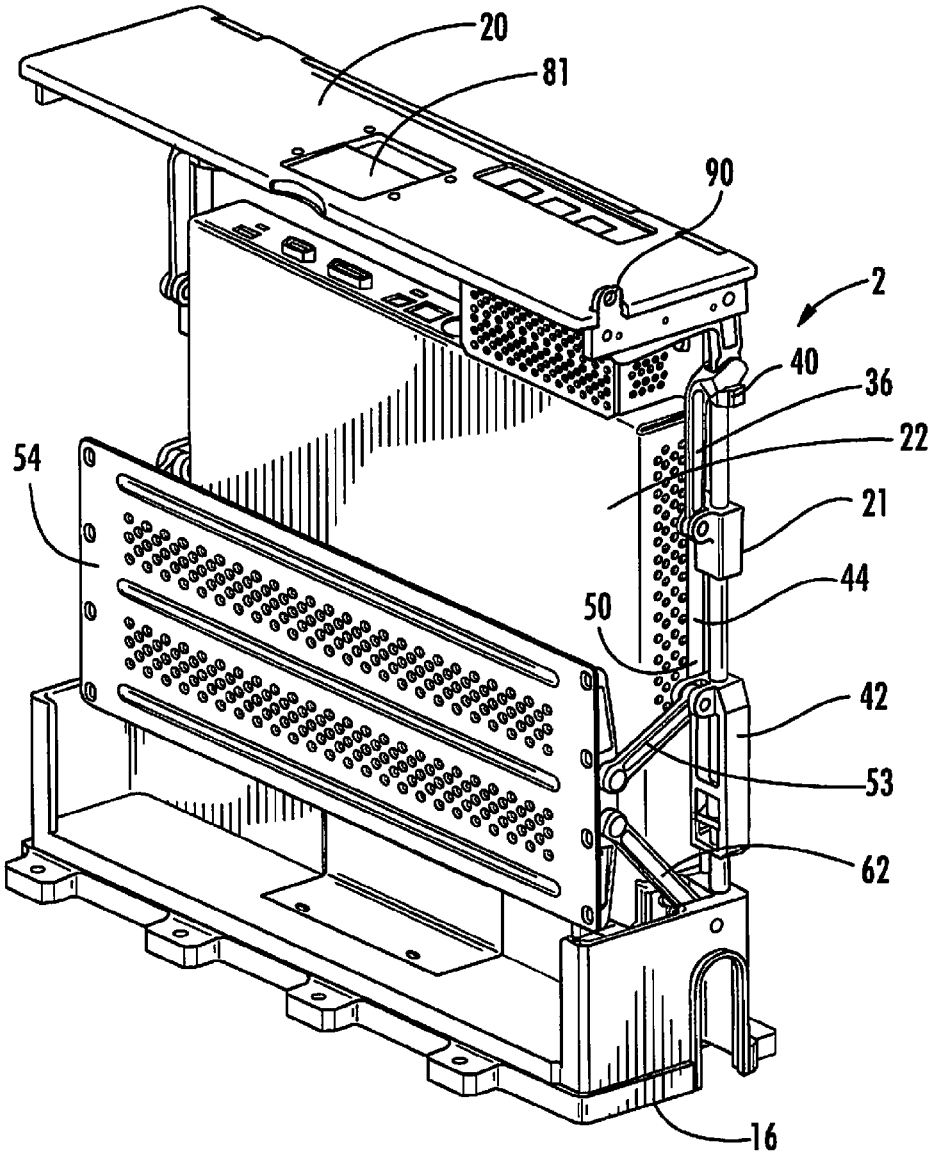
FIG. 6 is a cut away front perspective view of the stowing mechanism mounted on a base and in a closed position.
Figure 7:
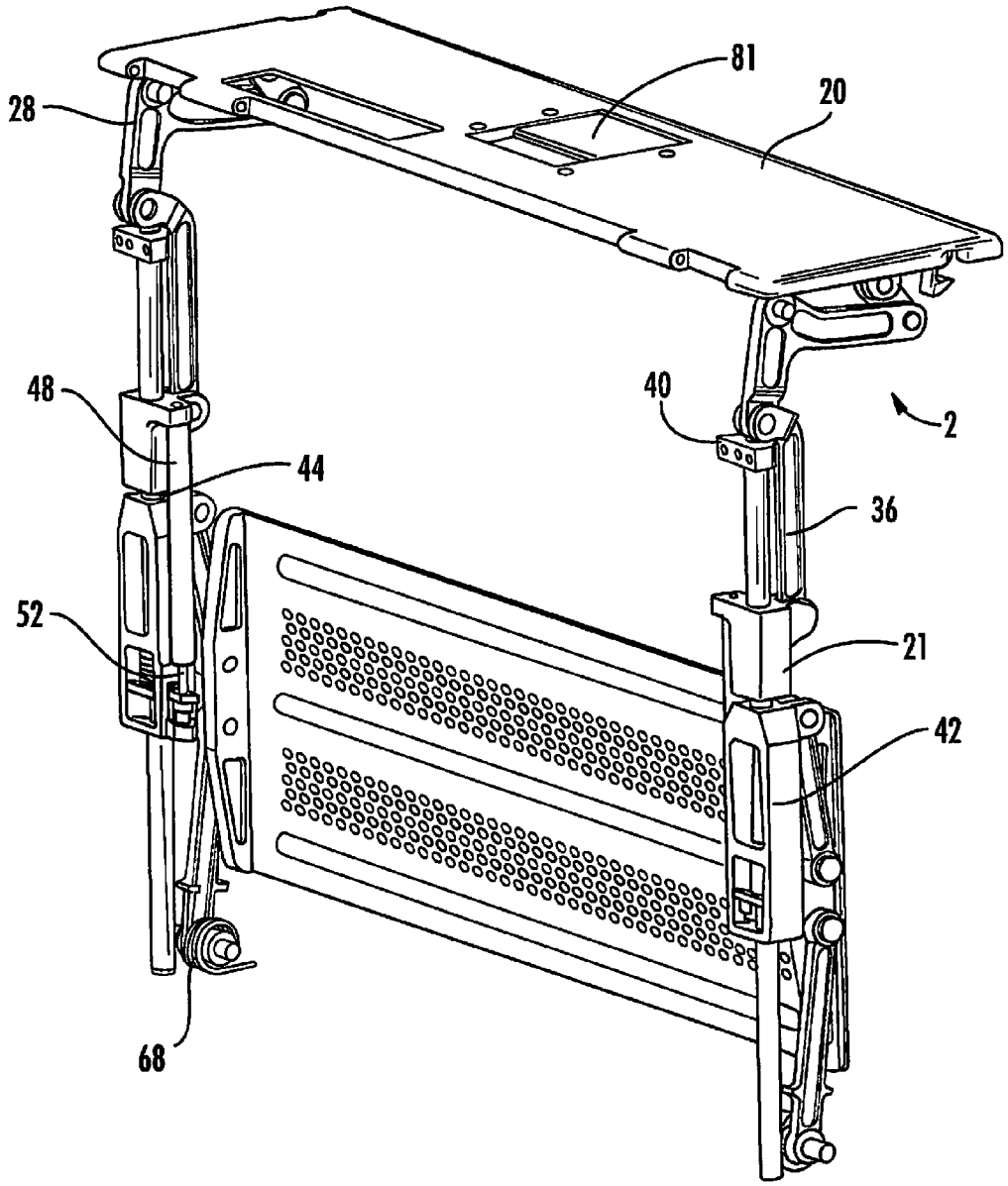
FIG. 7 is a cut away rear perspective view of the stowing mechanism in a closed position.

The sliding carriage 42 and the driving carriage 21 are selectively movable upon the slide rail 70. Preferably, the sliding carriage 42 and driving carriage 21 each contain a central bore on which they are held on the slide rail 70. Preferably, the slide rail 70 is anchored to the stationary structures at both ends of the slide rail 70 for stability. As mentioned above, the preferred embodiment uses an identical set of components (although such components can be mirror images of the components described above) on the opposite side of the compartment 6. FIGS. 5-7 show the components described above when the cover 20 is in the second or closed position. The cover 20 is pivotally mounted on an axis perpendicular to axes of the slide rails 70.

The mechanism of the invention can be best described by referring to FIGS. 3-4 and 6-7 which respectively show the parts in the first/open position and the second/closed position. It is to be understood that there are a number of intermediate positions between the first and second positions.

In the preferred embodiment, the cover 20 is used as the actuator for the jack mechanisms 56. As the cover 20 is pivotally moved toward the closed position, or downward toward the compartment 6, it moves the cover linkages 23, the driving carriages 21, the sliding carriages 42 and thus, the jack mechanisms 56 and pressure plate 54. More specifically, movement of the cover 20 from the open position to the closed position forces the pivot arm 28 to pivot around its pivot pin 30 such that the first extending link 32 is pushed toward a near horizontal position and the second extending link 34 is forced to a toward a near vertical position.

The movement of the second extending link 34 forces the driving carriage 21 downward on the slide rail 70 via the second connecting member 36. Since the gas spring 44 is attached between the driving carriage 21 and the sliding carriage 42, downward movement of the driving carriage 21 causes the gas spring 44 to move the sliding carriage 42 downward on the slide rail 70, overcoming the biasing force of the second spring 68. Placement of the gas spring 44 between the driving carriage 21 and the sliding carriage 42 maintains the gas spring 44 in alignment with the slide rail 70 at all times. This generally eliminates side loads on the gas spring 44, which side loads increase wear of internal sealing o-rings of the gas spring 44. Thus, the reliability and service life of the gas spring 44 are improved. The movement of the sliding carriage 42 moves the second end 58 of the first linkage arm 53 of the jack mechanisms 56, toward the second end 66 of the second linkage arm 62 thereby pushing the first ends 57, 64, and thus the pressure plate 54, toward the laptop 4. In this manner, the pivotal movement of the cover 20 is converted to the transverse movement of the pressure plate 54. That is, in the preferred embodiment, the pressure plate 54 moves in a direction perpendicular to the axes of the slide rails. Other movement orientations can be used in alternative embodiments.

At some point between the open and closed positions of the cover (depending on the thickness of the laptop or device), the pressure plate 54 contacts the laptop 4. Then, the gas spring 44 acts as a buffer between movement of the cover 20/driving carriage 21 and movement of the sliding carriage 42/pressure plate 54 to limit the amount of clamping pressure that can be applied against the laptop to prevent damage to the laptop, and to accommodate a range of thicknesses of laptops that can be effectively clamped between the compartment wall and the pressure plate. The range of lateral movement of the pressure plate to effectively clamp the desired range of thicknesses of laptops thus determines the minimum needed amount of compression of the gas spring 44, after considering the geometry of the operating mechanism. With a thicker laptop 4, the pressure plate 54 will contact the laptop 4 when the cover 20 is still a first distance from being in the closed position. On the other hand, the thinner the laptop is with respect to the thicker laptop 4, the nearer the cover 20 will be to the closed position when the pressure plate 54 contacts the laptop 4. At the point of contact of the pressure plate 54 with the laptop 4, the cover 20 will still not be in the closed position, whether the laptop is thick or thin (within the desired range of thicknesses to be covered). Further movement of the cover 20 to the closed position will cause compression of the gas spring 44, with greater compression for a thicker laptop and lesser compression for a thinner laptop. The use of a gas spring 44 allows the amount of pressure exerted by the gas spring on the sliding carriage 42, and thus, the amount of pressure exerted by the pressure plate 54 on the laptop 4, to remain relatively constant whether the laptop 4 is thick or thin. The spring force for the drive springs is selected to provide a clamping force sufficient to secure the device without causing damage to the device. Once the cover 20 is in the fully closed position, the laptop 4 or other device is secured.

The use of a drive spring 44 on each of the pair (or other number) of operating mechanisms also allows for accommodation of irregularly shaped laptops by allowing for different amounts of movement of opposite ends of the pressure plate 54. Each of the drive springs 44 can compress a different amount, thereby allowing each jack mechanism, and thus, each side of the pressure plate 54, to move a different amount toward the laptop 4, independently of one another within a reasonable allowable plate deflection, to accommodate a laptop 4 that is thicker on one side than on the other side. In an alternative embodiment, the pressure plate 54 can be mounted to each of the flanges 60 on vertically pivotal joints, thereby allowing greater pivoting of the pressure plate 54 from side to side to accommodate greater side to side thickness variations of devices. In the embodiment shown, the pressure plate 54 is connected on opposite sides to the first and second jack mechanisms. In another alternative embodiment, each jack mechanism can have its own separate pressure plate. The pressure plate 54 is also pivotal top to bottom about first ends 57 and 64 of the first and second linkage arms 53 and 62 to conform to wedge shaped top to bottom profiles (as the device is situated in the compartment) of different devices.

In the embodiment shown, each drive spring 44 is positioned beside and parallel with its respective slide rail. By positioning the spring between a topward mounted lug on the driving carriage 21 and a bottomward mounted lug on the sliding carriage 42 (see FIG. 4), the allowable length of the drive spring 44 can be increased, along with the range of compression of the drive spring 44, thereby accommodating a greater range of thicknesses of laptops to be stowed.

In a preferred embodiment, the pressure plate 54 will have a relatively soft surface that engages the laptop 4 to prevent scratching or other damage to the laptop 4, as well as to provide a better clamping grip between the pressure plate 54 and the laptop 4. This surface can be an integral part of the pressure plate or a separate surface material attached to or applied over the pressure plate 54.

Another feature of the stowing mechanism 2 is the "over-center" operation of the cover 20/pivot arm 28. The location of the pivotable attachment of the second connecting member 36 and the pivot arm 28 is on one side of the drive spring 44 in the opened position and crosses over a center of compression of the drive spring 44 as the pivot arm 28 travels from the open position to the closed position, thereby resulting in a downward pulling force on the cover after the pivot arm crosses over the center of compression of the drive spring. This results in a positive tactile feel for the user indicating that the cover has completely closed, as well as helps maintain the cover 20 in the closed position.

To further maintain the cover 20 in the closed position, the cover 20 is also equipped with a positive latch mechanism 81 attached to the cover 20. In order to safeguard the contents of the compartment 6, a padlock ear 90 contains a bore which can receive a padlock or other locking instrument and thereby prevent opening of the cover 20 until the lock is removed.

In reversing the process and going from a closed position to an open position, the latch 81 is pulled upward releasing the cover 20 so that the cover 20 can be rotated to the open position, thereby reversing the operation described above.

The base 16 can include features which allow two or more boxes 3 to be stacked back to back to one another. First power cords and other cords necessary to run the laptop can enter the compartment 6 through a cavity 92, thus allowing the cords to enter the bottom of wall 12. Additionally, the lugs 94 on the front of the base 16 are offset from the lugs 94 on the rear of the base 16 to allow a nesting relationship between the lugs of a front side of one stowing mechanism with the lugs of a rear side of a second stowing mechanism.

Other embodiments are possible, including one in which the second end of the gas spring is attached directly to the pressure plate 54. Such an embodiment would omit the sliding carriage and the parts associated with the sliding carriage. Another embodiment is one in which the first end of the gas spring 48 is attached directly to the L-shaped pivot arm 28. Such an embodiment would omit the drive carriage and the parts associated with the drive carriage. Additionally, there are possible embodiments which remove, combine and/or reshape some of the linkages. Still other embodiments may remove certain parts such as the second spring and/or the latch mechanism. Another embodiment utilizes a compression coil spring between the driving carriage and sliding carriage instead of the gas spring. In such an embodiment, the compression spring can be positioned around the slide rail, as compared to the sideward positioning of the gas spring described above. Other types of springs can also be used throughout.

Figure 8:
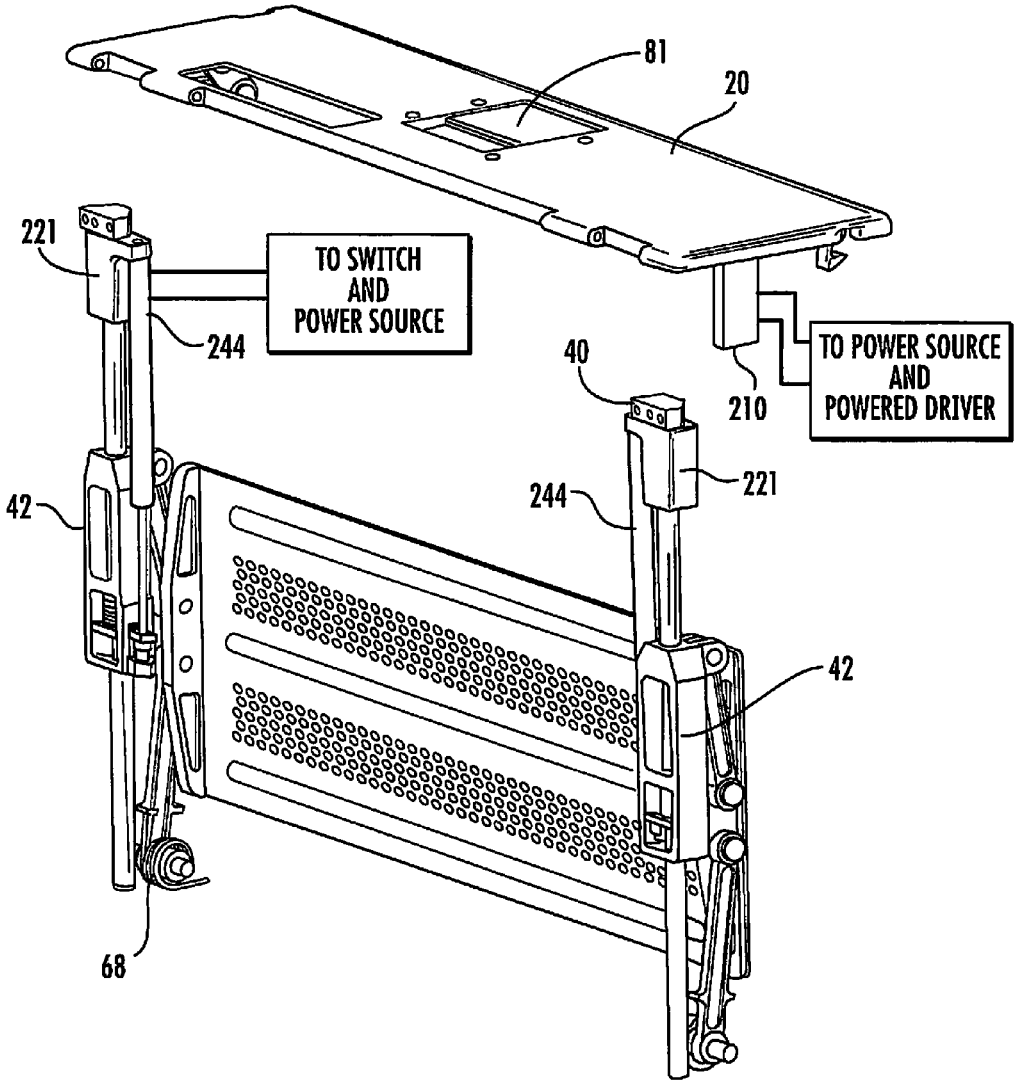
FIG. 8 is a cut away rear perspective view of an alternative embodiment of the stowing mechanism in a closed position.

In an alternative embodiment, the stowing mechanism 2 can use one or more powered drive mechanisms for actuating the jack mechanisms. The powered drive mechanism can include a powered screw mechanism, a linear drive motor, a hydraulic/air cylinder, or another type of powered drive mechanism. See FIG. 8. A powered drive mechanism 244 is attached between powered drive mount 221 and sliding carriage 42 of each jack mechanism for moving the respective sliding carriage 42 between the clamped and unclamped positions. A spring mechanism can be positioned between each powered drive mechanism 244 and either the powered drive mount 221 and the sliding carriage 42 to act as a buffer spring, as described above. A switch 210 is positioned to be actuated by the opening and closing of the cover 20 and is operatively connected to the powered drive mechanisms 244 for connecting to and disconnecting from a power supply, thereby powering on and powering off the powered drive mechanisms 244. Operation of the powered drive mechanisms 244 can also be at least partially controlled by a controller.

Also, operation of the switch or actuator can be separated from operation of the cover. Although the stowing device is shown vertically receiving the laptop, other orientations can also be used. The stowing device can be used in other environments, including helicopters, boats, trains, wheeled vehicles, military vehicles, construction vehicles, other types of vehicles, or even in stationary locations.

The use of the stowing mechanism of the present invention provides for quick and easy stowing of a laptop or other device brought into the environment. The stowing mechanism secures the device against movement and protects the device from external impact or other damage. When desired, the laptop can be quickly and easily unsecured and removed from the stowing mechanism, with the stowing mechanism then ready to receive another laptop. The described stowing mechanism provides for the secure holding of a wide range of sizes, shapes and types of laptops or other devices without modification to the stowing mechanism or procedure for using the stowing mechanism.

Figure 9:
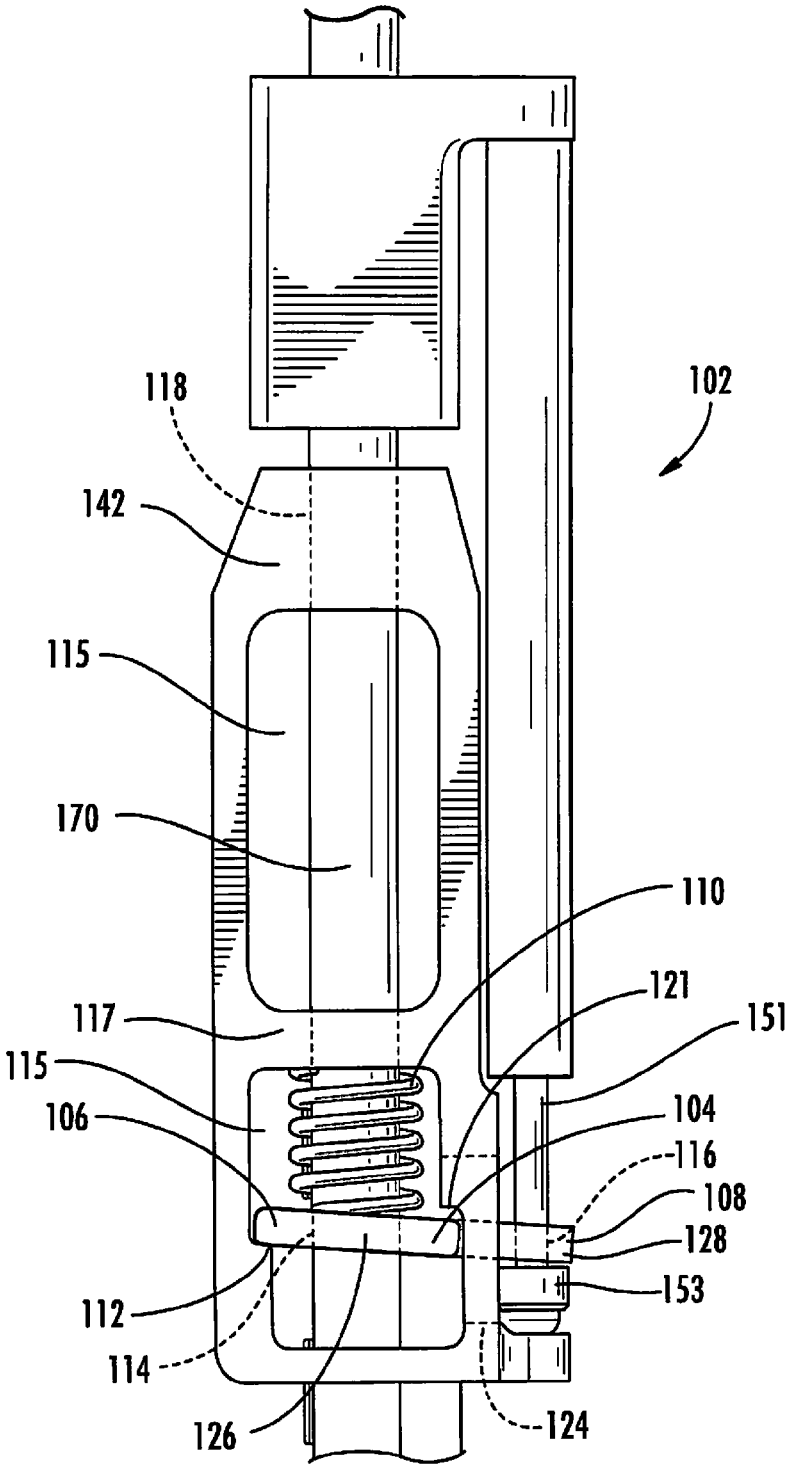
FIG. 9 is a rear view of the locking mechanism on the slide rail in a locked position.
Figure 10:
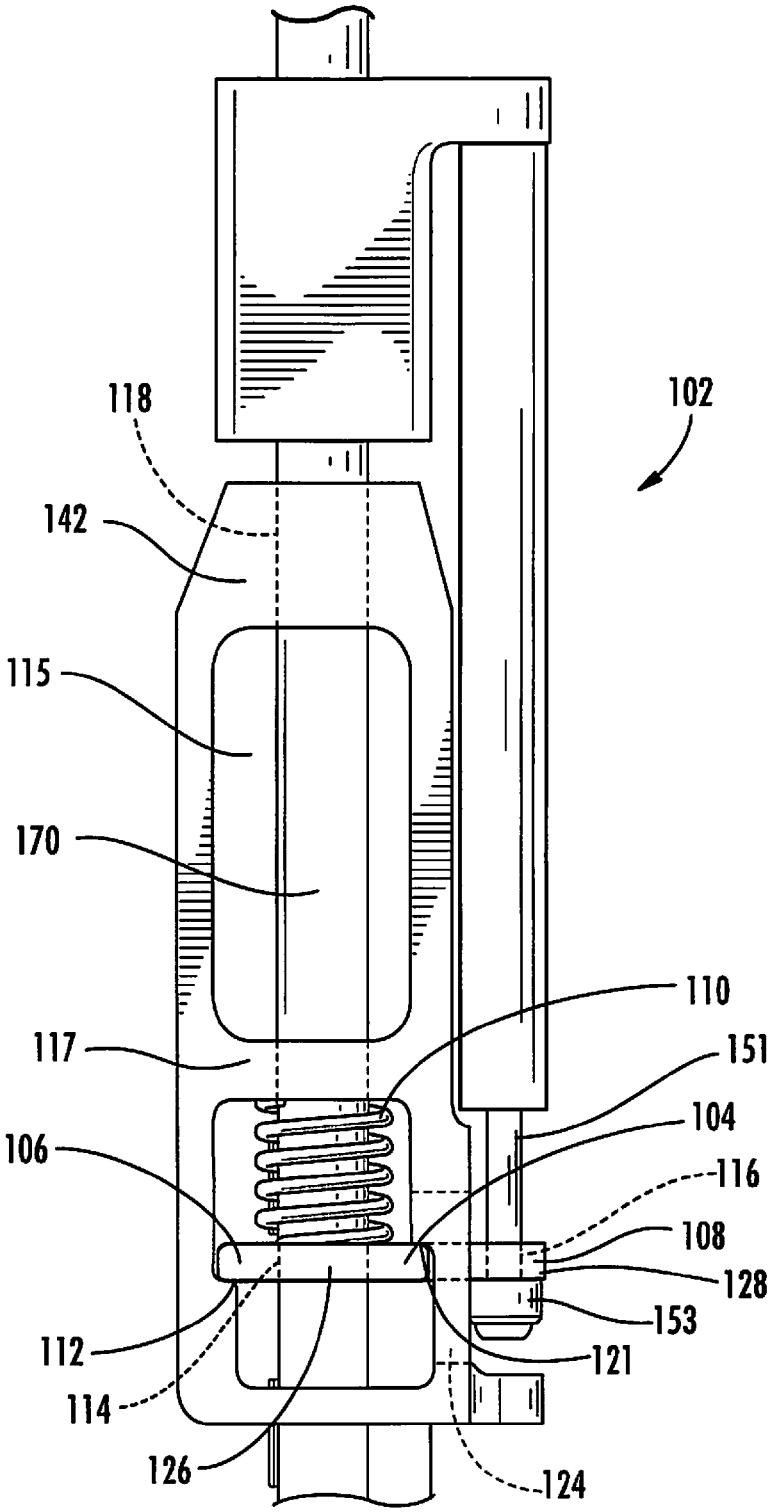
FIG. 10 is a rear view of the locking mechanism on the slide rail in an unlocked position.

A sliding lock mechanism 102 is shown in FIGS. 9-10. FIG. 9 shows the mechanism 102 in a locked first position while FIG. 10 shows the mechanism 102 in an unlocked second position. The mechanism 102 includes a sliding carriage 142 which is selectively slideably movable on a slide rail 170. The sliding carriage 142 includes a central bore 118 in which the slide rail is positioned so that the sliding carriage 142 slideably movable on the slide rail 170. In the shown embodiment, the slide rail 170 is cylindrical and the central bore is also cylindrical, but other interacting shapes can be used as well. The sliding carriage 142 includes an interior open portion 115 and a ledge 112 positioned in the open portion 115 which serves as a pivot mount for a binding bar 104. The binding bar 104 can also be pivotally mounted to the sliding carnage 142 or slide rail 170 in other manners. A cross-member 117 separates the open portion 115. The open portion 115 reduces the weight of the mechanism 102 while providing space within the sliding carriage 142 for operating components of the sliding lock mechanism 102.

The binding bar 104 has a central bore 114 configured to be positioned over the slide rail 170. The bore 114 can be generally round or oval shaped to interact with the cylindrical slide rail 170 but can have other shapes as well, especially if the slide rail 170 has other than a cylindrical shape. The bore 114 is sized with respect to the slide rail 170 so that when the binding bar 104 is orientated generally perpendicular to the slide rail 170 (the unlocked second position), the binding bar 104 is frictionally released from the slide rail 170 and can slide freely, or relatively freely, on the slide rail 170; however, when the binding bar 104 is tilted away from the perpendicular orientation toward the locked first position with respect to the slide rail 170, edges of the bore 114 will frictionally engage the slide rail 170 and prohibit movement of the binding bar 104 along the slide rail 170. The binding bar 104 also has a first end 106 and a second end 108, with the first end 106 being pivotally positioned on the ledge 112 and the second end 108 extending beyond an exterior surface of the sliding carriage 142 through a slot 124 in the sliding carriage 142. The binding bar 104 also contains a second bore 116 positioned external to the sliding carriage 142 adjacent the second end 108. A spring 110 is positioned between the cross-member 117 and the binding bar 104 to bias the binding bar 104 toward the locked first position. The spring 110 is preferably a compression coil spring having an inner bore to allow positioning over the slide rail 170, however, the spring 110 can be externally mounted with respect to the sliding carriage 142 and/or slide rail 170. In an alternative embodiment, the cross-member 117 can be omitted and a longer spring 110 can engage between the binding bar 104 and an upper surface of the open portion 115.

The spring 110 provides a biasing force against the binding bar 104 such that the binding bar 104 pivots downward on the ledge 112 toward the skewed, locked first position where the binding bar 104 engages the slide rail 170 and prevents the sliding carriage 142 from moving in an upward direction. While in this position, the sliding carriage is basically locked against upward movement, as the strong upward force that would need to be applied to the sliding carriage 142 to overcome the frictional force between the binding bar 104 and the slide rail 170 will not be encountered under normal operating conditions. Thus, the sliding carriage is maintained in a stable position. However, a downward force applied on the sliding carnage 142 that is less than the strong upward force will move the sliding carriage 142 in the downward direction. In this manner, the sliding lock mechanism has a self-tightening operation when used in conjunction with the stowing mechanism 2. Under conditions of vibration, or jostling/impact of the stowing mechanism 2, the sliding carriage 142 can move in the downward direction, thus imparting additional clamping force on the pressure plate 54, but the sliding carriage cannot be moved in an upward direction, and thereby allowing undesirable loosening or backdriving of the pressure plate 54, without releasing the binding bar 104.

To release the binding bar 104 from the first locked position, an actuating rod 151 is positioned through the second bore 116. The actuating rod 151 has an actuating head 153 positioned on a downward side of the binding bar 104, opposite the spring 110. The head 153 is larger than the second bore 116 so as to be able to impart a releasing force on the underside of the binding bar 104. In a locked state, the actuating head 153 will be positioned away from the underside of the binding bar so that there is a clearance between the two components and the binding bar is able to be biased as far as possible toward the locked position. An upward force then applied to the actuating rod 151 will bring the actuating head 153 into contact with the underside of the binding bar 104 and pull the binding bar 104 upward, overcoming the biasing force of the spring 110 and moving the binding bar toward the unlocked/released perpendicular orientation with respect to the slide rail 170. In an alternative embodiment, the actuating rod 151 can be directly attached to the binding bar 104, which eliminates the need for the second bore 116 and the actuating head 153.

The binding bar 104 can have a stepped shape with a wider portion 126 of the shape being positioned adjacent the first end 106 and within the open portion 115, and a narrower portion 128 of the shape being positioned the second end 108 and extending through the slot 124, which is dimensioned to allow the narrower portion 128 to freely pass through while being too narrow for the wider portion 126 to pass through. This configuration allows pivoting operation of the binding bar 104 with respect to the slide rail 170 but helps prevent the binding bar 104 from moving laterally with respect to the sliding carriage 142 and possibly sliding off of the ledge 112. The sliding carriage 142 also includes a stop ledge 121 which prevents the binding bar 104 from moving past the perpendicular second position in the releasing/locking direction, thereby preventing the binding bar 104 from undesirably engaging the slide rail 170 and binding, when a release of the locking mechanism is desired. In the released/unlocked position, the sliding carriage 142 can freely move in both directions along the slide rail 170.

Figure 11:
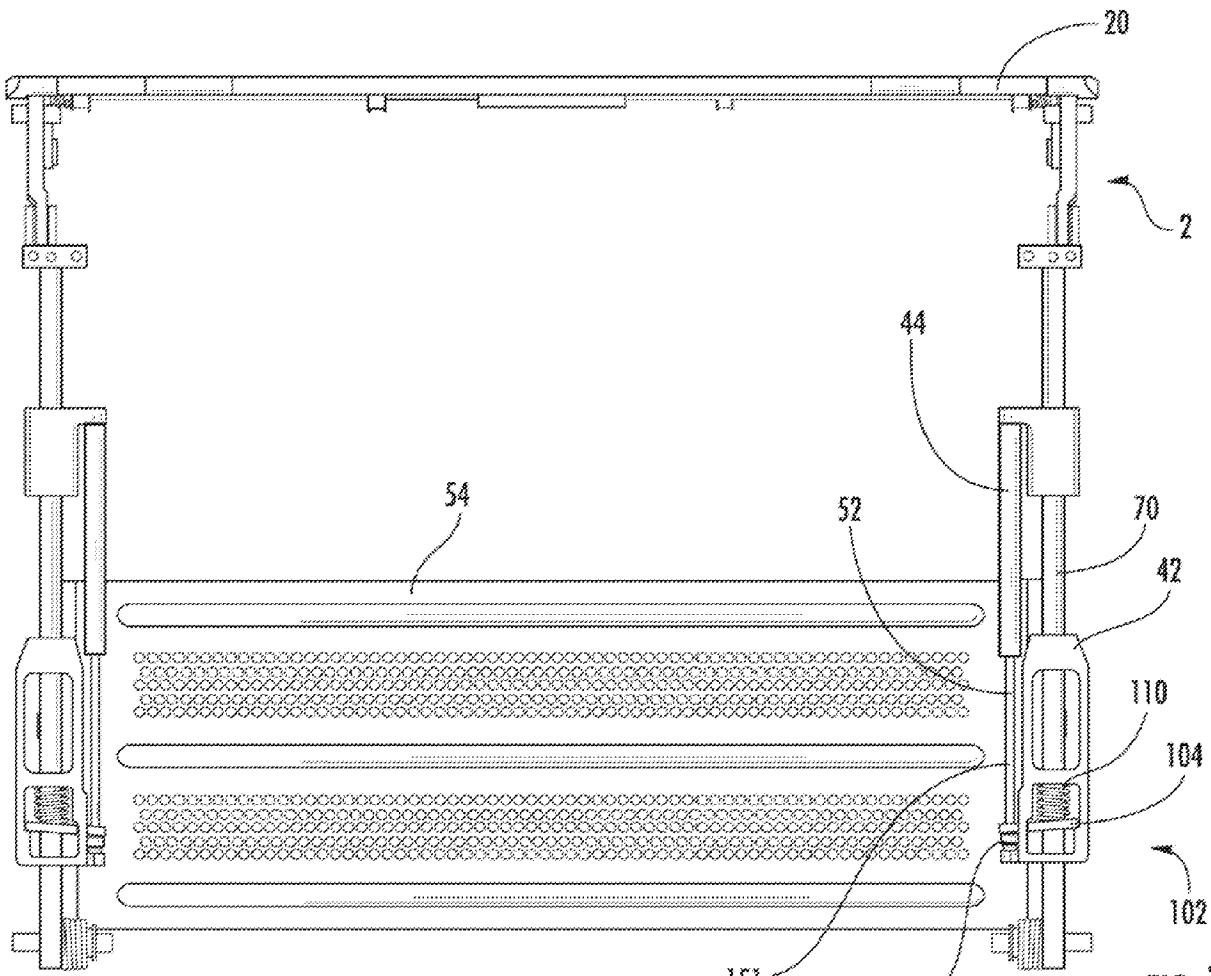
FIG. 11 is a rear view of the locking mechanism in conjunction with the laptop stowing mechanism.

Now referring to FIG. 11, the sliding lock mechanism 102 is shown in conjunction with the stowing mechanism 2. The sliding lock mechanism 102 is located on the same slide rail 70 and shares the same sliding carriage 42 as the stowing mechanism 2. In addition, the ram 52 of the spring 44 serves as the actuating rod 151 for the sliding lock mechanism 102. The sliding carriage 42 can travel toward the base of the unit in a direction of clamping/securing of the laptop 4 while the binding bar 104 is in either the first or second position, with the sliding carriage 42 moving relatively freely while the binding bar 104 is in the second position but requiring a stronger downward force on the sliding carriage 42 while the binding bar 104 is in the first position, as described above. However, the sliding carriage 42 is prevented from moving upward toward the cover 20 in a direction of unclamping/unsecuring the laptop 4 until the binding bar 104 is moved/pulled to the second position by the actuating rod 151. In this manner, the pressure plate 54 is prevented from coming loose from the laptop or other device 104, thereby leading to a less secured or unsecured laptop or other device 104. Additionally, this operation allows for the self-tightening of the pressure plate, as described above.

In practice, when the cover 20 is opened from a closed position, the actuating head 153 pulls up on the binding bar 104 and compresses the spring 110 which allows the binding bar 104 to enter the unlocked position. The cover 20, therefore, not only actuates the spring mechanisms, it also causes the binding bar 104 to move between the locked and unlocked positions. The sliding carriage 42 can then slide upward on the slide rail 70 toward the released/unclamped position. Once the force keeping the binding bar 104 in the unlocked position terminates, i.e. movement of the cover toward the open position is stopped, the binding bar 104 returns to its locked position due to the biasing force of the spring 110. At this point the sliding carriage 42 can only move in one direction which in the preferred embodiment is toward the base of the box 3. In this embodiment, the end of the ram 52/actuating rod 151 also engages the sliding carriage 42 to push the sliding carriage 42 downward upon closing of the cover 20.

Having thus described the invention in connection with the several embodiments thereof, it will be evident to those skilled in the art that various revisions can be made to the several embodiments described herein with out departing from the spirit and scope of the invention. It is my intention, however, that all such revisions and modifications that are evident to those skilled in the art will be included with in the scope of the following claims. Any elements of any embodiments disclosed herein can be used in combination with any elements of other embodiments disclosed herein in any manner to create different embodiments.

What is claimed is:

1. A stowing mechanism for a device comprising:

an actuator;

a first jack mechanism;

a compartment formed between the jack mechanism and another structure for receiving the device;

wherein the actuator is selectively movable to actuate the first jack mechanism between a secured position securing the device and an unsecured position allowing the device to be inserted into and removed from the compartment;

a sliding carriage;

a slide rail, with the sliding carriage slideably mounted on the slide rail;

the sliding carriage including a ledge;

a binding bar having a first end, a second end and an aperture for positioning over a portion of the slide rail, wherein the first end is positioned on the ledge such that the binding bar is pivotable with respect to the ledge, the binding bar being pivotable on the ledge to a locked first position pivoted away from perpendicular with respect to the slide rail to engage the slide rail in the first position and prevent movement of the sliding carriage in one direction within a set force range, the binding bar also being pivotable on the ledge to an unlocked second position generally perpendicular to the slide rail to release from the slide rail and allow the sliding carriage to move in two directions on the slide rail;

a spring mechanism exerting a biasing force on the binding bar to bias the binding bar toward the first position;

an actuating rod for engaging the binding bar to overcome the bias of the spring and move the binding bar between the locked first position and the unlocked second position.

2. The mechanism of claim 1, wherein:

the actuator is a powered drive mechanism comprising at least one of a powered screw mechanism, a linear drive motor and a hydraulic/air cylinder;

and further comprising a switch operatively connected to the powered drive mechanism for powering on and powering off the powered drive mechanism.

3. The mechanism of claim 1, wherein:

the second end of the binding bar contains a bore;

at least a portion of the actuating rod is positioned within the bore;

the actuating rod has an actuator head that is movable with the actuating rod in a first direction to engage the binding bar and move the binding bar toward the unlocked second position;

the sliding carriage includes a stop ledge positioned to engage the binding bar to prevent movement of the binding bar beyond the perpendicular orientation with respect to the slide rail when being moved toward the unlocked second position;

the sliding carriage has a slot through which the second end of the binding bar extends;

the binding bar has a stepped shape with a wider portion of the stepped shape positioned adjacent the first end of the binding bar and a narrower portion of the stepped shape extending through the slot of the sliding carriage, the slot being narrower than the wider portion of the binding bar to retain the binding bar in an operating position with respect to the sliding carriage.

4. The mechanism of claim 1, wherein:

the engagement between the binding bar, the spring mechanism and the slide rail is such that when the binding bar is in the locked position and the sliding carriage is locked against movement in the first direction, the sliding carriage is still movable in a second direction on the slide rail away from the first direction upon application of a force to the sliding carriage in the second direction;

a pressure plate attached to the first jack mechanism and engaging the device and exerting a securing pressure on the device at the secured position;

a drive spring attached between the actuator and the pressure plate to act as a buffer between movement of the actuator and movement of the pressure plate to accommodate devices of varying widths;

wherein the first jack mechanism comprises a first linkage arm and a second linkage arm;

wherein the first linkage and second linkage arm each has a first end and a second end;

wherein the first end of each linkage arm is pivotally attached at separated points to the pressure plate to allow pivoting of the pressure plate with respect to the first and second linkage arms to better engage an irregularly shaped device;

wherein the second end of the second linkage arm is pivotally attached to a stationary structure;

wherein the second end of the first linkage arm is pivotally attached to the sliding carriage;

wherein the drive spring is attached between the sliding carriage and the actuator such that further movement of the actuator of the actuator after the pressure plate is in engagement with the device causes compression of the drive spring between the actuator and the sliding carriage;

a driving carriage;

the driving carriage slideably mounted on the slide rail;

an operating linkage attaching the actuator to the driving carriage such that pivotal movement of the actuator causes movement of the driving carriage along the slide rail;

wherein the drive spring is connected between the drive carriage and the sliding carriage such that movement of the drive carriage along the slide rail causes movement of the sliding carriage along the slide rail;

wherein the operating linkage includes:

a pivot arm pivotally attached to a housing at a central portion and having a first extending link and a second extending link each extending away from the central portion at an angle with respect to one another;

a first connecting member pivotally attached between the actuator and the first extending link at a point spaced away from the central portion of the pivot arm;

a second connecting member pivotally attached between the drive carriage and the second extending link at a point spaced away from the central portion of the pivot arm; the second connecting member being generally L-shaped so that as the pivot arm is moved by the actuator toward the closed position, the pivotal attachment between the second connecting member and the pivot arm crosses over a center of compression of the drive spring such that once over center, the drive spring exerts a closing pressure on the actuator.

5. The mechanism of claim 1, wherein:

the second end of the binding bar contains a bore;

at least a portion of the actuating rod is positioned within the bore.

6. The mechanism of claim 1, wherein:

the actuating rod has an actuator head that is movable with the actuating rod in a first direction to engage the binding bar and move the binding bar toward the unlocked second position.

7. The mechanism of claim 1, wherein:

the sliding carriage includes a stop ledge positioned to engage the binding bar to prevent movement of the binding bar beyond the perpendicular orientation with respect to the slide rail when being moved toward the unlocked second position.

8. The mechanism of claim 1, wherein:

the sliding carriage has a slot through which the second end of the binding bar extends.

9. The mechanism of claim 8, wherein:

the binding bar has a stepped shape with a wider portion of the stepped shape positioned adjacent the first end of the binding bar and a narrower portion of the stepped shape extending through the slot of the sliding carriage, the slot being narrower than the wider portion of the binding bar to retain the binding bar in an operating position with respect to the sliding carriage.

10. The mechanism of claim 3, wherein:

the engagement between the binding bar, the spring mechanism and the slide rail is such that when the binding bar is in the locked position and the sliding carriage is locked against movement in the first direction, the sliding carriage is still movable in a second direction on the slide rail away from the first direction upon application of a force to the sliding carriage in the second direction.

11. The mechanism of claim 1, further comprising:

a pressure plate attached to the first jack mechanism and engaging the device and exerting a securing pressure on the device at the secured position.

12. The mechanism of claim 11, further comprising:

a drive spring attached between the actuator and the pressure plate to act as a buffer between movement of the actuator and movement of the pressure plate to accommodate devices of varying widths.

13. The mechanism of claim 11, wherein:

the first jack mechanism comprises a first linkage arm and a second linkage arm;

wherein the first linkage and second linkage arm each has a first end and a second end;

wherein the first end of each linkage arm is pivotally attached at separated points to the pressure plate to allow pivoting of the pressure plate with respect to the first and second linkage arms to better engage an irregularly shaped device.

14. The mechanism of claim 13, wherein:

wherein the second end of the second linkage arm is pivotally attached to a stationary structure;

wherein the second end of the first linkage arm is pivotally attached to the sliding carriage.

15. The mechanism of claim 1, further comprising:

a driving carriage;

the driving carriage slideably mounted on the slide rail.

16. The mechanism of claim 15, further comprising:

an operating linkage attaching the actuator to the driving carriage such that pivotal movement of the actuator causes movement of the driving carriage along the slide rail.

17. The mechanism of claim 1, wherein:

the actuating rod is a ram of a gas spring.

18. The mechanism of claim 2, wherein:

the second end of the binding bar contains a bore;

at least a portion of the actuating rod is positioned within the bore;

the actuating rod has an actuator head that is movable with the actuating rod in a first direction to engage the binding bar and move the binding bar toward the unlocked second position;

the sliding carriage includes a stop ledge positioned to engage the binding bar to prevent movement of the binding bar beyond the perpendicular orientation with respect to the slide rail when being moved toward the unlocked second position;

the sliding carriage has a slot through which the second end of the binding bar extends;

the binding bar has a stepped shape with a wider portion of the stepped shape positioned adjacent the first end of the binding bar and a narrower portion of the stepped shape extending through the slot of the sliding carriage, the slot being narrower than the wider portion of the binding bar to retain the binding bar in an operating position with respect to the sliding carriage.

19. The mechanism of claim 18, wherein:

the engagement between the binding bar, the spring mechanism and the slide rail is such that when the binding bar is in the locked position and the sliding carriage is locked against movement in the first direction, the sliding carriage is still movable in a second direction on the slide rail away from the first direction upon application of a force to the sliding carriage in the second direction;

a pressure plate attached to the first jack mechanism and engaging the device and exerting a securing pressure on the device at the secured position;

a drive spring attached between the actuator and the pressure plate to act as a buffer between movement of the actuator and movement of the pressure plate to accommodate devices of varying widths;

wherein the first jack mechanism comprises a first linkage arm and a second linkage arm;

wherein the first linkage and second linkage arm each has a first end and a second end;

wherein the first end of each linkage arm is pivotally attached at separated points to the pressure plate to allow pivoting of the pressure plate with respect to the first and second linkage arms to better engage an irregularly shaped device;

wherein the second end of the second linkage arm is pivotally attached to a stationary structure;

wherein the second end of the first linkage arm is pivotally attached to the sliding carriage;

wherein the drive spring is attached between the sliding carriage and the actuator such that further movement of the actuator after the pressure plate is in engagement with the device causes compression of the drive spring between the actuator and the sliding carriage;

a driving carriage;

the driving carriage slideably mounted on the slide rail;

an operating linkage attaching the actuator to the driving carriage such that pivotal movement of the actuator causes movement of the driving carriage along the slide rail;

wherein the drive spring is connected between the drive carriage and the sliding carriage such that movement of the drive carriage along the slide rail causes movement of the sliding carriage along the slide rail;

wherein the operating linkage includes:

a pivot arm pivotally attached to a housing at a central portion and having a first extending link and a second extending link each extending away from the central portion at an angle with respect to one another;

a first connecting member pivotally attached between the actuator and the first extending link at a point spaced away from the central portion of the pivot arm;

a second connecting member pivotally attached between the drive carriage and the second extending link at a point spaced away from the central portion of the pivot arm; the second connecting member being generally L-shaped so that as the pivot arm is moved by the actuator toward the closed position, the pivotal attachment between the second connecting member and the pivot arm crosses over a center of compression of the drive spring such that once over center, the drive spring exerts a closing pressure on the actuator.

* * * * *